United States Patent [19]

Bocard et al.

[11] 4,362,631

[45] Dec. 7, 1982

[54] SPECIAL TRAWL NET FOR COLLECTING FLOATING PRODUCTS

[75] Inventors: Christian Bocard, Orgeval; Maurice Lemesre, Wervicq-Sud, both of France

[73] Assignees: Institut Francais du Petrole, Rueil-Malmaison; Societe Anonyme Cousin Freres, Wervicq-Sud, both of France

[21] Appl. No.: 245,770

[22] Filed: Mar. 20, 1981

[30] Foreign Application Priority Data

Mar. 21, 1980 [FR] France ..... 80 06419

[51] Int. Cl.[3] ..... E02B 15/04

[52] U.S. Cl. ..... 210/776; 210/800; 210/242.3; 210/242.4; 210/923

[58] Field of Search ..... 210/923, 800, 776, 242.4, 210/242.3

[56] References Cited

U.S. PATENT DOCUMENTS

| | | | |
|---|---|---|---|
| 3,653,510 | 4/1972 | Fitzgerald | 210/242 |
| 3,662,891 | 5/1972 | Headrich | 210/242 |
| 3,724,662 | 4/1973 | Prtiz | 210/923 |
| 3,756,294 | 9/1973 | Rafney | 210/923 |
| 3,796,656 | 3/1974 | Avey | 210/923 |
| 3,966,614 | 6/1976 | Ayers | 210/923 |
| 4,057,498 | 11/1977 | Vidilles | 210/923 |
| 4,104,884 | 8/1978 | Preus | 210/923 |
| 4,211,659 | 7/1980 | Nyfelde | 210/923 |
| 4,294,698 | 10/1981 | Bronnec | 210/923 |

FOREIGN PATENT DOCUMENTS

| | | | |
|---|---|---|---|
| 7314741 | 11/1974 | France | 210/242 |
| 7902664 | 8/1979 | France | 210/242 |

*Primary Examiner*—John Adee

*Attorney, Agent, or Firm*—Millen & White

[57] ABSTRACT

A special trawl net for collecting floating products has a dorsal or upper face of a close-mesh netting which extends over the two wings of the trawl and forms on the ventral or lower face thereof two lateral strips separated by a central net zone having a wider-mesh netting, so that water can easily escape therethrough. An impervious sleeve surrounding the bag formed by the trailing end of the trawl, and extending beyond this trailing end, is connected to the bag at one end and is open at its other end. This sleeve makes it possible to sealingly enclose the bag when the latter is filled with the products to be collected.

14 Claims, 6 Drawing Figures

SPECIAL TRAWL NET FOR COLLECTING FLOATING PRODUCTS

BACKGROUND OF INVENTION

The present invention relates to a special trawl-net for collecting floating products, such as, for example, but not exclusively, hydrocarbon agglomerates resulting from the action of natural elements on a hydrocarbon layer spread over the water surface, or from the treatment of such a layer by the spreading of a binding agent.

It has already been proposed in U.S. Pat. No. 3,653,510 to provide a funnel-shaped collecting device which is towed at the water surface so as to skim floating products which are collected at the trailing or rear end of the device. However, this device is made of an impervious sheet material and thus has a high drag in water.

It has also been proposed in French Pat. No. 2 416 305 to provide a device for collecting materials floating at the water surface, this device comprising two vertical walls made up of nets supported by upright buoyant members, these two walls being respectively connected to tug boats and defining a tapered channel which guides the products to be collected to a gathering portion of the device also composed of netting and located on the rear part or trailing end of the device.

This prior device does not provide in all cases for an efficient channelling of the products towards the gathering rear part, particularly in rough sea.

Moreover, this device comprises a certain number of elements, such as the upright buoyant members which makes it difficult to put the device into operation.

It has been proposed to substitute for this device, a trawl-type netting which comprises, in addition to lateral walls, a ventral or lower face and a dorsal or upper face, for the purpose of better channeling of the products towards the rear part or trailing end where these products are gathered. Such a modification is described in the French Pat. No. 2 227 750.

However, in order to obtain a sufficient efficiency of the latter-discussed trawl net in the contemplated application, it is necessary to make use of a close-mesh netting, which increases the drag or resistance of the trawl to towing.

SUMMARY OF THE INVENTION

The object of the invention is therefore to provide a net of this type which, while ensuring the efficient gathering of the floating products, even of small size, has a reduced drag in water.

This device provides the additional advantage of being usable even in rough sea with swells which can reach 1 meter to 1.50 meter.

This result is obtained, according to the invention, by using a special trawl-type net adapted to collect floating products, such as hydrocarbon agglomerates resulting from the action of natural elements on a hydrocarbon layer spread over the water surface, or from the treatment of such a layer by spreading thereon a binding agent. The net defines a flattened pocket adapted to be towed by means of two wings held in spaced relationship from each other, and connected to said pocket at the level of an inlet opening thereof, said pocket having a funnel-shaped leading part with a flattened cross-section progressively decreasing from said inlet opening, and said leading part having a dorsal or upper face and a ventral or lower face and being connected to a trailing end or trawl rear part the meshes of said dorsal face having a size comprised between 2 and 10 millimeters, so as to form a close-mesh netting which also covers the upper part of said trawl wings and extends over the lower part of said wings and over said ventral face. This trawl is characterized in that said close-mesh netting is comprised on said ventral face of two lateral or side strips separated by a central net zone of wider-mesh netting to facilitate water discharge.

BRIEF DESCRIPTION OF DRAWINGS

The invention is illustrated by the accompanying drawings wherein.

DETAILED DISCUSSION OF THE INVENTION

Figure 1:
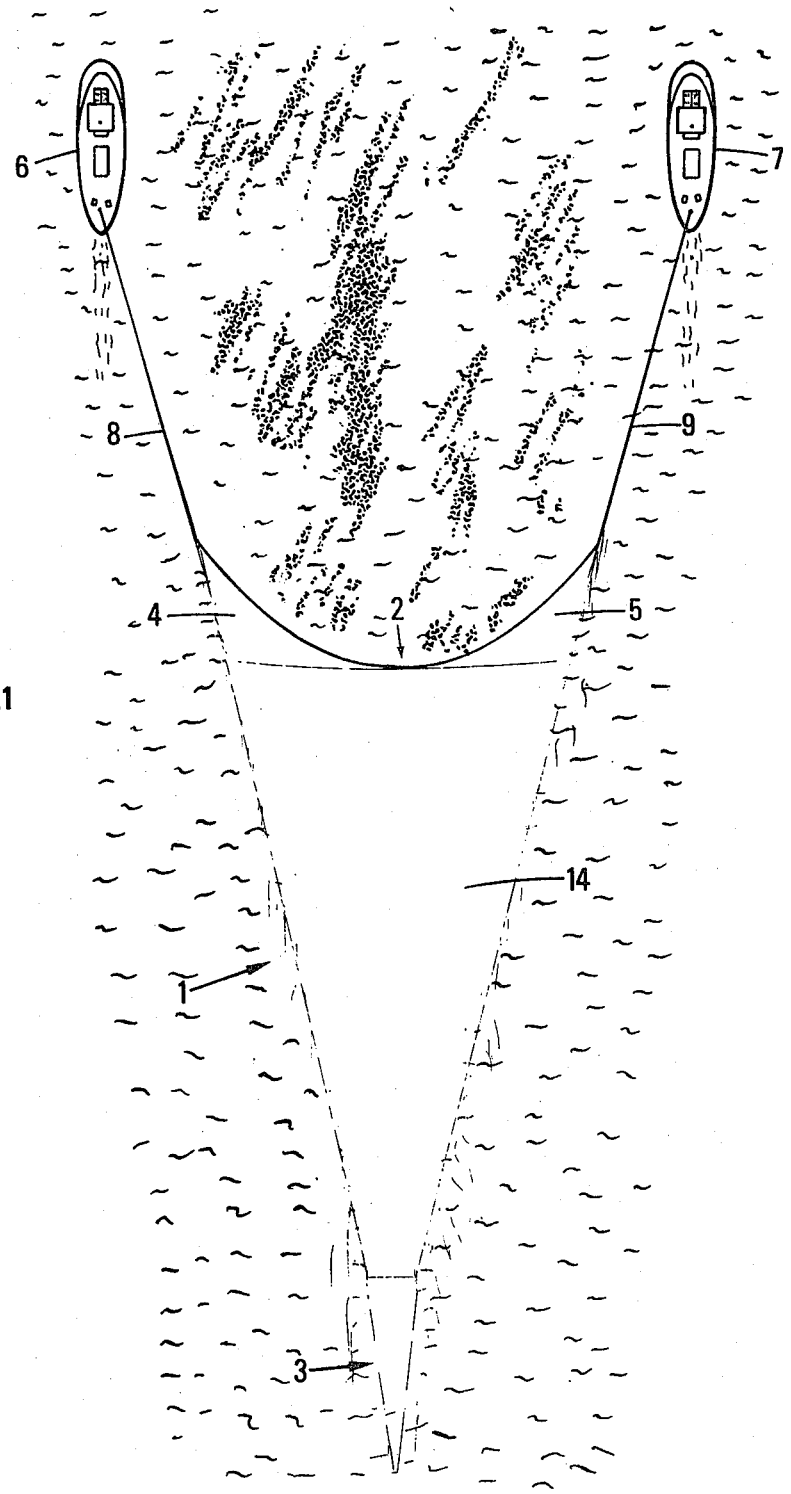
FIG. 1 is a diagrammatic top view illustrating the operation of a net according to the invention.
Figure 2:
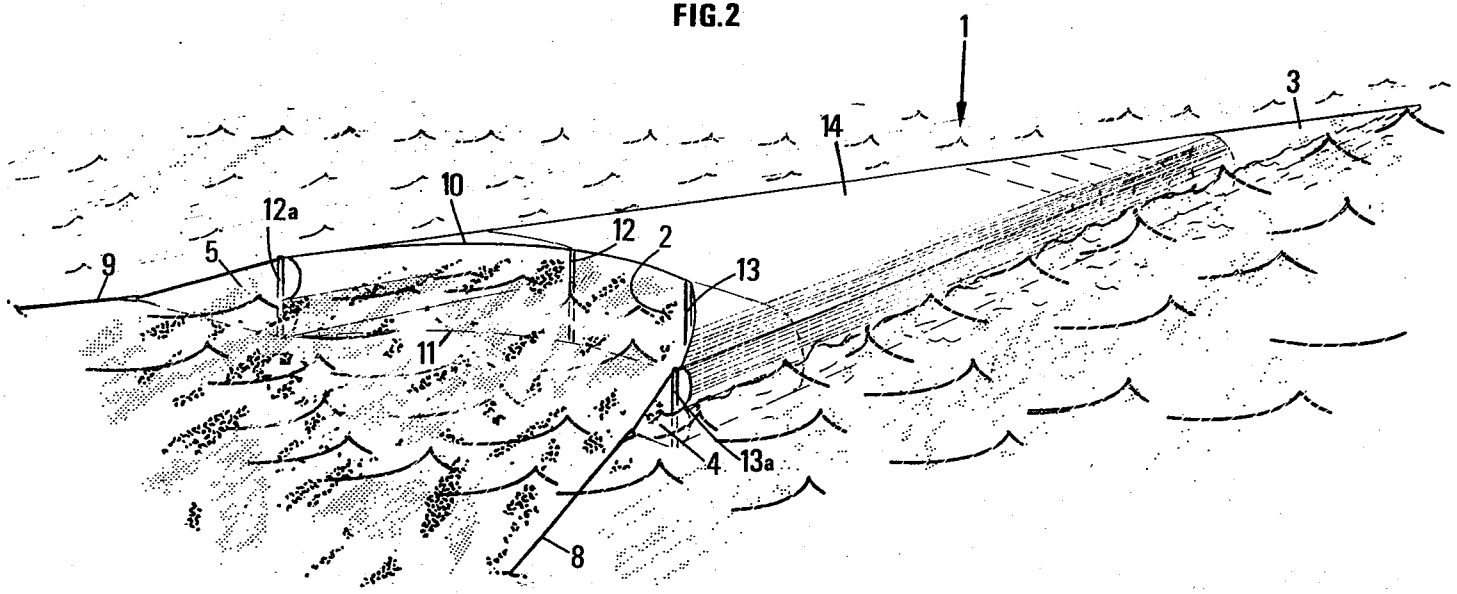
FIG. 2 is a perspective view of this net.

In the drawings illustrating a net according to the invention shaped as a flattened pocket to collect floating products, the reference 1 designates the leading part of this net having an inlet opening 2, and the reference 3 is the trailing end or rear part of the trawl wherein the collected products are gathered. The references 4 and 5 designate the two wings of this trawl, connected with the pocket at the level of the opening 2. These wings, which are located at a distance from each other, enable the net to be towed by means of two tug boats 6 and 7 (like an ox-driven cart), using two cables, or ropes 8 and 9.

The illustrated net is provided with a rope surrounding the opening 2 and forming an opening rope 10 for the dorsal or upper face of the trawl and is provided with a lower rope 11 at the lower edge or flange of the opening 2.

Upright members 12 and 13 firmly hold the dorsal and ventral ropes 10 and 11 at a distance from each other, thus maintaining a substantially constant width of the opening 2 of the net.

Wing straighteners **12*a* and 13*a* maintain the wings 4 and 5 flat and help in keeping the trawl open, and in maintaining its dorsal face defined by rope 10** at a sufficient height above the water level to prevent the dorsal face from being submerged when the sea is swelling.

Figure 3:
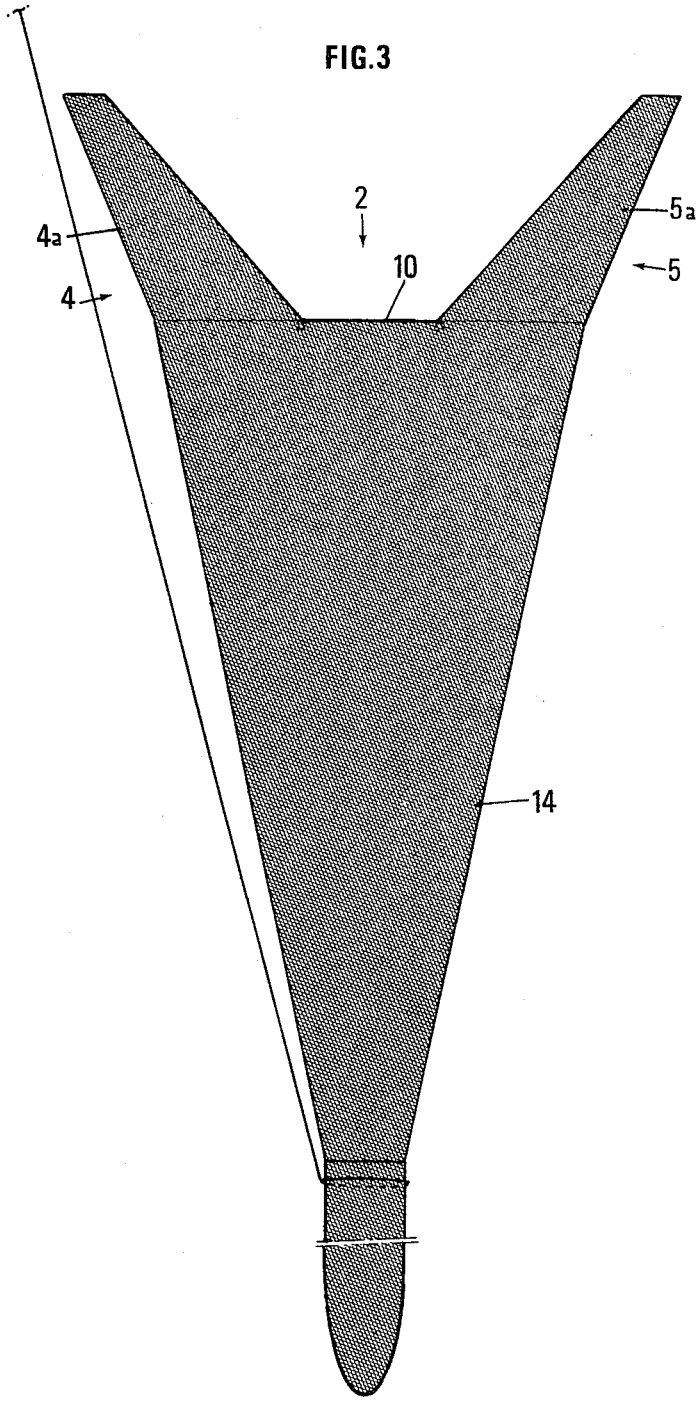
FIG. 3 shows the structure of the dorsal part and of the wings of this net.
Figure 4:
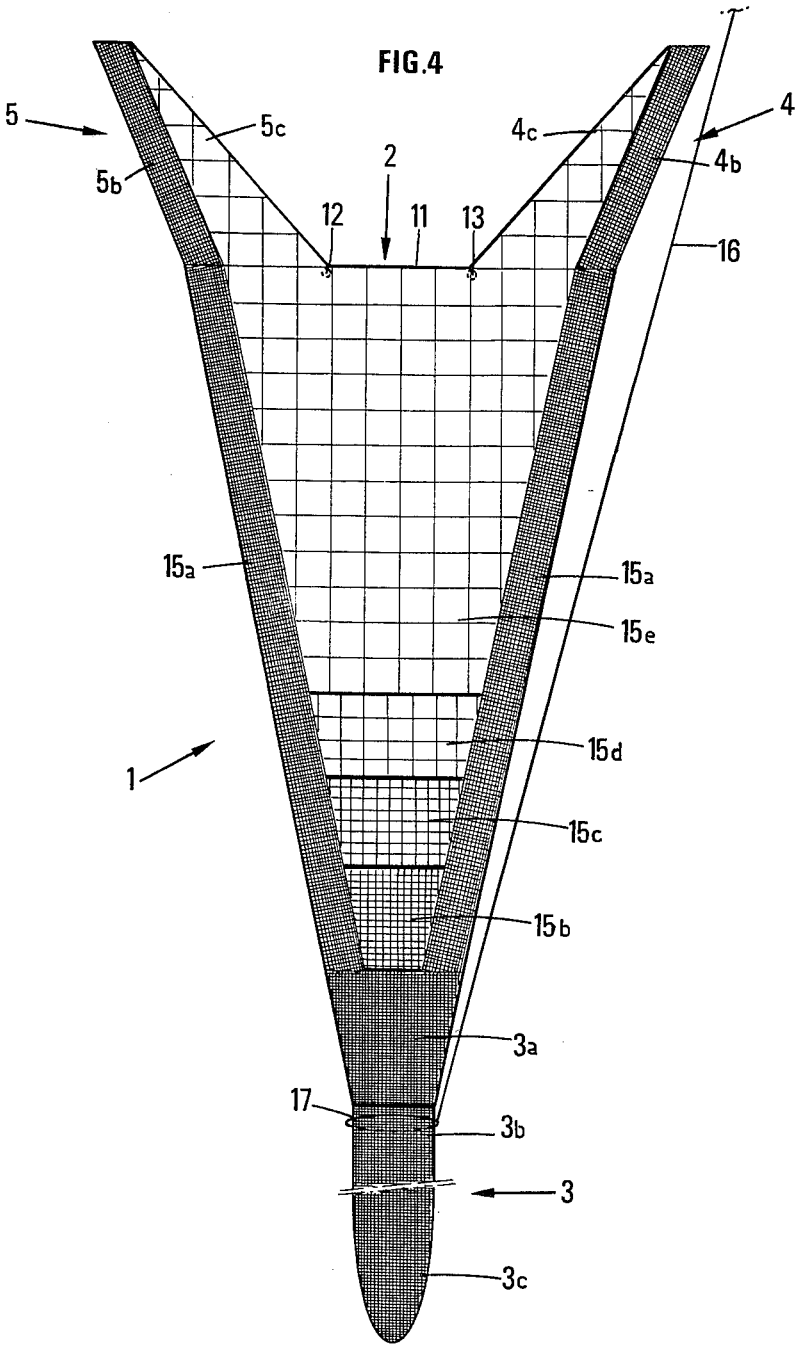
FIG. 4 shows its ventral face.

The leading part of the net is funnel-shaped with a flattened cross-section progressively decreasing from the inlet opening 2 and comprising a dorsal or upper face 14 (FIG. 3) and a ventral or lower face 15 (FIG. 4).

The overall length of the net, from the ends of the wings 4 and 5, to the end of the trawl trailing part is, for example, comprised between 60 and 80 meters, its maximum opening width between the ends of the wings being comprised between 15 and 80 meters and its maximum opening height, between the dorsal rope 10 and the ventral rope 11, being comprised between 2 and 3 meters.

The dorsal rope 10 is for example a polypropylene rope of a 20 mm diameter and 40 to 50 meters in length.

The above dimensions are of course only given by way of example.

The dorsal face 14 of the net has mesh openings of a size from 2 to 10 millimeters, for example 6 millimeters. This face is for example, made of twisted or stranded 6,660 meter/kilogram polyamide wire.

The close-mesh netting of the dorsal face 14 of the trawl also covers the upper part (*4a, 5a,* FIG. 3) and at least a portion (side strips *4b, 5b,* FIG. 4) of the lower part of the wings 4 and 5, and it extends over the ventral or lower face 15 of the net to constitute thereon two lateral strips or bands 15*a* with a close-mesh netting (from 2 to 10 millimeter meshes, for example 6 millimeters) separated by a central zone 15*b* to 15*e* with a wider-mesh netting (for example from 12 to 100 millimeter meshes) which facilitates the discharge of water from the trawl.

According to a particular embodiment illustrated in FIG. 4, two lateral strips of 200 mesh openings of a size of 6 millimeters made of 6,600 m/kg polyamide wire, are located on the ventral or lower face of the net from the end of the wings 4 and 5 to the inlet portion 3*a* of the trawl rear part or trailing end 3, the lateral strips 15*a* on the ventral face being in the extension of the lateral strips 4*a* and 5*a* of the wings.

In the central part or zone of the ventral or lower face of the net, located between the lateral strips 15*a*, the size of the mesh openings progressively increases from the trailing part to the leading part of the net, so as to reach a value comprised between 80 and 150 millimeters in the vicinity of the net inlet opening.

For example (FIG. 4), starting from the inlet portion 3*a* of the net trailing end 3, two parts having different size meshing may be distinguished in the structure of the ventral or lower face of the trawl: a zone 15*b* with 12 millimeter mesh openings of 2,200 m/kg polyamide wire, a zone 15*c* with 25 millimeter mesh openings of 1060 m/kg polyamide wire, and a zone 15*d* of 50 millimeter mesh openings of 600 m/kg polyamide wire.

These three consecutive zones are followed with an "upper ventral zone" 15*e* of 100 millimeter mesh openings, this meshing extending over the remaining lower portion 4*c*, 5*c* of the wings 4 and 5.

The extension 3*b* and the bag-shaped end portion of the trailing part of the trawl are, like the inlet portion 3*a* of the trailing part, made up of a close-mesh netting (2 to 10 millimeter mesh openings, for example 6 millimeter mesh openings of 6,600 m/kg polyamide wire).

Such a structure makes it possible to efficiently channel the floating products towards the trailing end of the trawl, the close-mesh netting of the dorsal face 14 and of the lateral strips *4b, 5b,* 15*a* of the ventral face preventing these products from escaping from the net, for example, when a wave trough uncovers a portion of the wings 4 and 5, whereas water can easily flow through the central zone 15*b*, 15*c*, 15*d*, 15*e*, 4*c*, 5*c* of the ventral or lower face of the net.

The trailing end of the trawl will advantageously be detachable and optionally equipped with means for increasing its buoyancy (see below), and provided with a rope 16 forming a loop with a running slip, or throttling line, so that this trailing end of the trawl can be closed when it is filled up, and so that it may be disconnected from one of the tug-boats.

The entire trailing end 3 of the trawl may be coated or lined with a reinforcing netting which may be of a relatively wide-mesh netting (40 millimeter meshes for example), and may be advantageously formed of a plastic material having a positive buoyancy, such as polyethylene, or polypropylene, so as to increase the buoyancy of this trailing portion of the trawl (this buoyancy being already ensured by the collected product itself). This buoyancy is necessary when the trailing portion 3*c* of the trawl is released from the latter.

A special net having the above indicated characteristics can be towed by two trawlers of average tonnage of the type used for small-scale fishing, for example, at a speed of 2 to 5 knots, the distance between these boats not exceeding for example 50 meters and the trawl being positioned at a distance of 20 to 30 meters from the boats.

The dorsal rope 10 of the trawl is normally located at a height of 0.50 to 1 meter above the water level.

Floats may be attached to the net and to the upright members of the trawl to help maintain the net above the water level.

When the trawl is fully open the boats steer to the layer of products to be collected. These products reach the lateral walls of the trawl, their penetration into the trawl being faster as water is more easily discharged through the ventral portion of the trawl whose mesh openings have a size which decreases towards the inlet portion 3*a* of the trailing end of the net. This inlet portion is defined by a close-mesh netting thus, preventing back-flowing which might occur when the bag 3*c* is nearly filled up.

When the bag 3*c* is filled up it is then closed and disconnected from the remainder of the trawl, secured to a buoy, and left in water. It is replaced by an empty bag without it being necessary to haul the entire trawl out of water. The so-marked full bags can be collected later on by a ship and, for example, simply tugged in water to a harbour or to a collecting station.

Figure 5:
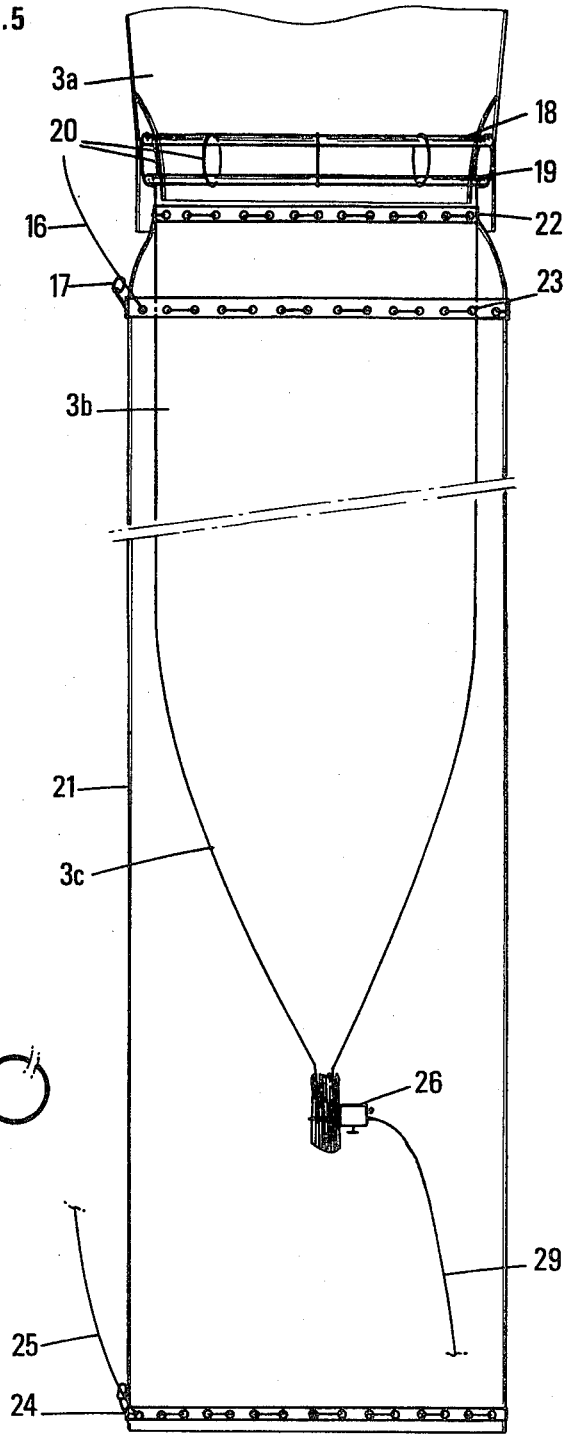
FIG. 5 illustrates an advantageous embodiment of the trawl.
Figure 6:
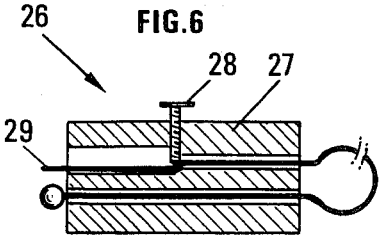
FIG. 6 is a detail view of a device for closing the trailing end of the trawl.

FIG. 5 illustrates a particularly advantageous embodiment of the trailing end of the trawl.

In this embodiment the inlet portion 3*a* of the trailing end is secured to a metal ring 18. Similarly the extension 3*b* is secured to a second ring 19, the rings 18 and 19 being interconnected by snap-hooks or any other detachable connecting means.

In order to form at least a wall which prevents leakage of the polluting products between the rings 18 and 19, the inlet portion 3*a* extends beyond the ring 19 towards the trailing end of the trawl.

An impervious cover 21 makes up a sleeve surrounding the assembly of 3*b* and 3*c*. The leading edge of this cover is either directly secured to the ring 19 or, as in the illustrated embodiment, connected at 22 to the extension 3*b*, immediately behind the ring 19.

A series of eyelets 23 are provided on the cover 21, so that the rope 16 can encircle this cover to form the loop 17.

The other end of the cover 21 is open in operation, so that water can escape when the trawl is towed in water, and is provided with another series of eyelets 24 so that this end can be encircled by a rope 25.

The trailing portion 3*c* of the trawl can be opened but is held closed in operation by a device 26 comprising an element 27 provided with a clamping screw 28 whereby a flexible rope 29 surrounding this trailing end can be clamped or released.

When a ship equipped with a tank for storing the polluting products is available, the assembly 3*b* and 3*c* is raised by means of the rope 16 as soon as the bag 3*c* is filled up and this bag is emptied aboard the ship by actuating the device 26 to open the end portion of the bag 3*c*.

However, when such storage means for the polluting products are not available, the bag 3*c*, filled with these products, is towed away after the impervious cover 21 has been gripped or squeezed at both ends by means of the ropes 16 and 25, and after the two rings 18 and 19 have been disconnected.

What is claimed is:

1. A special trawl type net, adapted for collecting floating products dispersed throughout the surface of a body of water, such as hydrocarbon agglomerates resulting from the action of natural elements on a hydrocarbon layer spread over the water surface, or from the treatment of such a layer by spreading a binding agent thereon, said net comprising a flattened pocket adapted for being towed by means of two wing sections held in spaced relationship from each other and connected to said pocket at the level of an inlet opening thereof, said pocket having a funnel-shaped leading portion with a flattened cross-section which progressively decreases from said inlet opening, said leading portion having a dorsal or upper face and a ventral or lower face, and connected to a trailing portion of the trawl net, said dorsal face and the rear portion of the trawl net having mesh openings of a size comprised between 2 and 10 millimeters, to define a close-mesh netting capable of permitting water to discharge therethrough and said close mesh netting also covering the upper part of said trawl net wing sections and overlaping the lower part of said wing sections and said ventral face, and wherein said close-mesh netting defines on said ventral face, two lateral strips separated by a central net zone of wider-mesh netting to facilitate water discharge therethrough.

2. A special net according to claim 1, wherein the size of the mesh openings in said central zone of the ventral part progressively increases from a trailing portion to a leading portion of the net, and reaches a value comprised between 80 and 150 millimeters in the vicinity of said inlet opening of the net.

3. A special net according to claims 1 or 2, wherein said dorsal face has mesh openings of a size close to 6 millimeters.

4. A special net according to claim 1 or 2, wherein said ventral face is connected to said trailing end by a transition zone comprising an inlet portion of said trailing end, and an extension having a meshing similar to that of said trailing end.

5. A special net according to claim 1 or 2, wherein said trailing end is lined with a reinforcing meshing made of a plastic material having a positive buoyancy.

6. A special net according to claim 1 or 2, wherein the trailing end of the net is detachable.

7. A special net according to claim 1, wherein the trailing end of the trawl is surrounded by an impervious coating or sleeve, the assembly of said sleeve and of said trailing end of the trawl further comprising means for detachably connecting this assembly to the remainder of the net, said sleeve extending beyond the trailing end of the trawl towards a rear end of said sleeve which is maintained open in operation, and closure means enabling the trailing end of the trawl to be enclosed within said impervious sleeve by squeezing thereof in the vicinity of said detachable connecting means and in the vicinity of said rear end of the sleeve.

8. In a trawl net adapted for collecting floating products, such as hydrocarbon agglomerates resulting from the action of natural elements on a hydrocarbon layer spread over the surface of a body of water, the net being a generally funnel shaped structure, towable at the surface of the water and adapted to collecting and directing the floating products to collecting means detachably connected thereto, the improvement comprising:

an assembly of a detachable trailing end of the trawl net and an impervious sleeve means surrounding said trailing end of the trawl net, with said sleeve means extending beyond the trailing end of the trawl net; connecting means operatively associated with said trailing end of the trawl net and with said sleeve for detachably connecting said assembly to the trawl net; and closure means for closing-off each end of said sleeve.

9. A special net according to claim 7 or 8, wherein said detachable connecting means interconnects two rings to which are respectively secured, on the one hand, the assembly of the trailing end of the trawl and said sleeve surrounding said trailing end and, on the other hand, the remainder of the net, said rings being internally covered by a wall preventing leakage of the polluting products.

10. A special net according to claim 7 or 8, wherein said closure means enabling the trailing end of the trawl to be enclosed within said impervious sleeve comprises two rope means for squeezing said sleeve respectively in the vicinity of said detachable connecting means and in the vicinity of said rear end of the sleeve.

11. A special net according to claim 1, 7 or 8, wherein said trailing end of the trawl comprises obturation means for enabling said trailing end to be opened when the trawl is to be emptied.

12. A trawl net according to claim 1, wherein said close-mesh netting connecting the two-lateral strips on the ventral face thereof comprises a netting having mesh openings which are progressively smaller in the direction of the rear end of the trawl net.

13. A method of collecting floating products from a body of water comprising towing a trawl-type net over the surface of the body of water to collect hydrocarbon agglomerates resulting from the action of natural elements on a hydrocarbon layer spread over the water surface, or from the treatment of such a layer by spreading a binding agent thereon, said trawl-type net comprising a flattened pocket adapted for being towed by means of two wing sections held in spaced relationship from each other and connected to said pocket at the level of an inlet opening thereof, said pocket having a funnel-shaped leading portion with a flattened cross-section which progressively decreases from said inlet opening, said leading portion having a dorsal or upper face and a ventral or lower face, and connected to a trailing portion of the trawl net, said dorsal face and the rear portion of the trawl net having mesh openings of a size comprised between 2 and 10 millimeters, to define a close-mesh netting capable of permitting water to discharge therethrough and said close mesh netting also covering the upper part of said trawl net wing sections and overlapping the lower part of said wing sections and said ventral face, and wherein said close-mesh netting defines on said ventral face, two lateral strips separated by a central net zone of wider-mesh netting to facilitate water discharge therethrough.

14. A method of collecting floating products from a body of water comprising: towing a trawl-type net over the surface of the body of water to collect hydrocarbon agglomerates resulting from the action of natural elements on a hydrocarbon layer spread over the water surface, or from the treatment of such a layer by spreading a binding agent thereon, said trawl-type net being a generally funnel shaped structure and having an assembly of a detachable trailing end of the trawl net and an impervious sleeve means surrounding said trailing end of the trawl net, with said sleeve means extending beyond the trailing end of the trawl net, connecting means operatively associated with said trailing end of the trawl net and with said sleeve for detachably connecting said assembly to the trawl net, and closure means for closing-off each end of said sleeve; conducting said towing with the trailing end of said sleeve closed; and disconnecting the assembly when full for removing collected agglomerates therefrom.

* * * * *